US007094112B2

(12) United States Patent
Arai et al.

(10) Patent No.: US 7,094,112 B2
(45) Date of Patent: Aug. 22, 2006

(54) SPRING CONNECTOR HAVING ELASTIC TERMINAL

(75) Inventors: Yoshitaka Arai, Tokyo (JP); Akihiro Yodogawa, Tokyo (JP)

(73) Assignee: Yokowo Co., Ltd., Tokyo (JP)

( * ) Notice: Subject to any disclaimer, the term of this patent is extended or adjusted under 35 U.S.C. 154(b) by 0 days.

(21) Appl. No.: 11/011,157

(22) Filed: Dec. 15, 2004

(65) Prior Publication Data

US 2005/0130507 A1 Jun. 16, 2005

(30) Foreign Application Priority Data

Dec. 16, 2003 (JP) ..... P2003-417930

(51) Int. Cl.
*H01R 13/24* (2006.01)

(52) U.S. Cl. ..... 439/700; 439/482; 439/824

(58) Field of Classification Search ..... 439/700, 439/482, 824
See application file for complete search history.

(56) References Cited

U.S. PATENT DOCUMENTS

| | | | | |
|---|---|---|---|---|
| 4,904,213 | A * | 2/1990 | Hock et al. | 439/824 |
| 5,681,187 | A | 10/1997 | Fukushima et al. | 439/700 |
| 6,716,043 | B1 * | 4/2004 | Ishizuka | 439/131 |
| 2005/0026510 | A1 * | 2/2005 | Orihara | 439/700 |

FOREIGN PATENT DOCUMENTS

| | | |
|---|---|---|
| EP | 1 253 674 A2 | 10/2002 |
| JP | 2003-17173 | 1/2003 |

* cited by examiner

*Primary Examiner*—Hae Moon Hyeon
(74) *Attorney, Agent, or Firm*—Morgan, Lewis & Bockius LLP

(57) ABSTRACT

An insulative casing has a bottom face to be mounted on a board member. A conductive pin is disposed in the casing so as to be slidable in a first direction parallel to the bottom face. A conductive terminal is disposed in the casing and has at least one elastic piece which is always brought into contact with an outer periphery of the pin from a second direction perpendicular to the first direction. An elastic member is disposed between the pin and the terminal so that a tip end of the pin is projected from the casing while being retractable in the first direction.

6 Claims, 8 Drawing Sheets

SPRING CONNECTOR HAVING ELASTIC TERMINAL

BACKGROUND OF THE INVENTION

The present invention relates to a spring connector which has high reliability and can be manufactured at low cost.

FIGS. 9A to 11C show a conventional spring connector disclosed in Japanese Patent Publication No. 2003-17173A.

The conventional spring connector comprises a plate-shaped terminal 10 made of conductive material, a conductive pin 12 which can slide with respect to the terminal 10, a coil spring 14 which is provided between the terminal 10 and the conductive pin 12 in a compressed state, and a holder 16 formed of insulating resin.

The terminal 10 is formed of an elongated sheet metal which has been folded to form a substantially U-shape as shown in FIG. 11C. A dented part 10*a* which opens in a forward direction is formed in one of the folded halves of the terminal 10, and a small protrusion 10*b* is formed at a center of a bottom edge of the dented part 10*a*, as shown in FIGS. 11A and 11B. The other of the folded halves serves as a connecting part 10*c* to be fixed by soldering or so to a circuit board (not shown).

The conductive pin 12 has a plunger part 12*a* having a relatively small diameter at its tip end side and a protruded part 12*b* having a relatively large diameter at its base end side. This protruded part 12*b* is provided with axially extending grooves 12*c* on both sides thereof. These grooves 12*c* are adapted to be engaged with opposed inner edges of the dented part 10*a* in the terminal 10, and the conductive pin 12 is arranged so as to slide with respect to the terminal 10 along the grooves 12*c*, as guides for the sliding movement. The conductive pin 12 is further provided with a blind hole 12*d* in an axial direction form its base end face. The terminal 10 and the conductive pin 12 may be plated with gold as required.

Then, the conductive pin 12 is slidably incorporated into the holder 16 such that a tip end of the plunger part 12*a* is projected from the holder 16 so as not to be pulled out. The terminal 10 appropriately fixed to the conductive pin 12 is also incorporated into the holder 16. The conductive pin 12 is so designed as to be slidable in an axial direction thereof and in a diagonal direction with respect to a bottom face of the holder 16. In this state, the coil spring 14 is provided in a compressed state between the conductive pin 12 and the bottom edge of the dented part 10*a* in the terminal 10, having its one end inserted into the blind hole 12*d* in the conductive pin 12 and the other end blocked by the protrusion 10*b* at the center of the bottom edge of the dented part 10*a* in the terminal 10 so as not to be displaced. Moreover, the connecting part 10*c* of the terminal 10 is disposed on the bottom face of the holder 16.

In this example, when a contact terminal 18 comes into contact with the tip end of the plunger part 12*a* of the conductive pin 12 in a direction parallel with the bottom face of the holder 16, as shown in FIG. 9B, the conductive pin 12 moves diagonally downward, while compressing the coil spring 14 along the inner edges of the dented part 10*a* in the terminal 10, as the guides. On this occasion, a force F in FIG. 9B is exerted on the conductive pin 12 in a direction of prying it, and the grooves 12*c* of the conductive pin 12 are strongly pressed against the inner edges of the dented part 10*a* in the terminal 10. In this manner, electrical connection between the conductive pin 12 and the terminal 10 can be reliably obtained.

In order to reliably obtain the electrical connection between the conductive pin 12 and the terminal 10, it is necessary for the conductive pin 12 to be pushed into the holder 16 in a direction inclined at a certain angle with respect to the bottom face of the holder, but not in parallel with the bottom face. In other words, the direction of pushing in the conductive pin 12 is so set as to be inclined at a certain angle with respect to a direction of movement of the contact terminal 18. Consequently, a height of the conductive pin 12 from the bottom face is increased by the amount of the inclination.

SUMMARY OF THE INVENTION

It is therefore an object of the invention to provide a spring connector in which even though a sliding direction in an conductive pin is in parallel with a bottom face of a holder, electrical connection between the conductive pin and a plate-shaped terminal can be reliably obtained.

In order to achieve the above object, according to the invention, there is provided a spring connector, comprising:

an insulative casing, having a bottom face to be mounted on a board member;

a conductive pin, disposed in the casing so as to be slidable in a first direction parallel to the bottom face;

a conductive terminal, disposed in the casing and having at least one elastic piece which is always brought into contact with an outer periphery of the pin from a second direction perpendicular to the first direction; and an elastic member, disposed between the pin and the terminal so that a tip end of the pin is projected from the casing while being retractable in the first direction.

With the above configuration, since the elastic piece is always brought into contact with the conductive pin, the electrical connection between the pin and the terminal can be reliably established even if the sliding direction of the pin is made parallel with the bottom face of the casing. Accordingly, the height dimension of the spring connector can be reduced.

Preferably, a pair of grooves are formed on both side portions of the pin so as to extend in the first direction. A pair of guide members are formed on one of the terminal and the casing so as to be fitted into the grooves, respectively. Each of the guide members comes in slide contact with an inner face of each of the grooves when the elastic piece is brought into contact with the pin.

In a case where the guide members are provided as a part of the terminal, since the guide members are brought into slide contact with the pin, the reliability of the electrical connection is further enhanced.

In a case where the guide members are provided as a part of the casing, since the guide members are monolithically molded with the casing made of resin or the like, the weight of the spring connector can be reduced. Furthermore, the shape of the terminal can be simplified.

Preferably, two elastic pieces are brought into contact with the pin from opposite sides.

Here, it is preferable that the elastic pieces are brought into contact with different positions in the first direction.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE INVENTION

Embodiments of the invention will be described below in detail with reference to the accompanying drawings.

First, with reference to FIGS. 1A to 3C, a spring connector according to a first embodiment will be described.

Figure 2A:
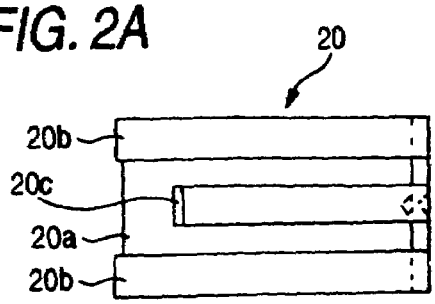
FIG. 2A is a top view of a terminal in the spring connector of FIG. 1A.
Figure 2B:
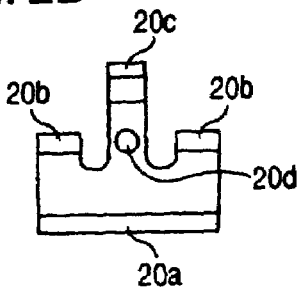
FIG. 2B is a front view of the terminal of FIG. 2A.
Figure 2C:
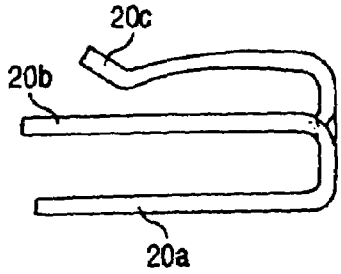
FIG. 2C is a side view of the terminal of FIG. 2A.
Figure 3A:
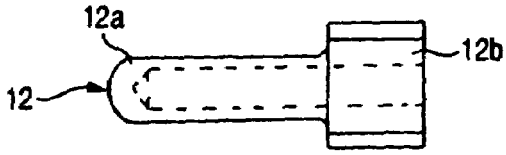
FIG. 3A is a top view of a conductive pin in the spring connector of FIG. 1A.
Figure 3B:
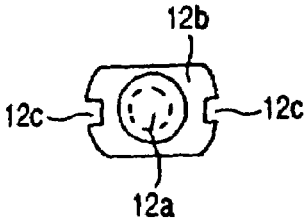
FIG. 3B is a front view of the conductive pin of FIG. 3A.
Figure 3C:
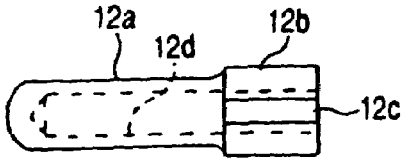
FIG. 3C is a side view of the conductive pin of FIG. 3A.

The conductive pin 12 as shown in FIGS. 3A to 3C, which is the same as the one employed in the above described conventional example, has a plunger part 12*a*, a protruded part 12*b*, grooves 12*c*, and a blind hole 12*d*. A plate-shaped terminal 20 formed of conductive material is made of an elongated sheet metal which has been folded into halves in a substantially U-shape, as shown in FIG. 2C. One of the folded halves is divided lengthwise into three parts, namely, a center part and both side parts as shown in FIGS. 2A and 2B. The both side parts are formed substantially in parallel with the other of the folded halves which serves as a connecting part 20*a*, and inside edges of the both side parts are opposed in parallel with each other to form guide parts 20*b*.

The center part is formed as an elastic contact part 20*c* which is adapted to be brought into elastic contact with the conductive pin 12 from above. When the inner edges of the guide parts 20*b* are engaged with the grooves 12*c* in the conductive pin 12, the conductive pin 12 is allowed to slide by the aid of the guide parts 20*b*. It is apparent that the elastic contact part 20*c* is brought into elastic contact with the conductive pin 12 within a sliding range of the conductive pin 12.

Moreover, the terminal 20 is provided with a protrusion 20*d* for blocking the coil spring 14 from being displaced at its base end side. Then, the coil spring 14 is disposed in a compressed state between the conductive pin 12 and the terminal 20 having its one end inserted into the blind hole 12*d* in the conductive pin 12 and the other end blocked by the protrusion 20*d* of the terminal 20 from being displaced, and in this state, the conductive pin 12 is assembled to the terminal 20.

Figure 1A:
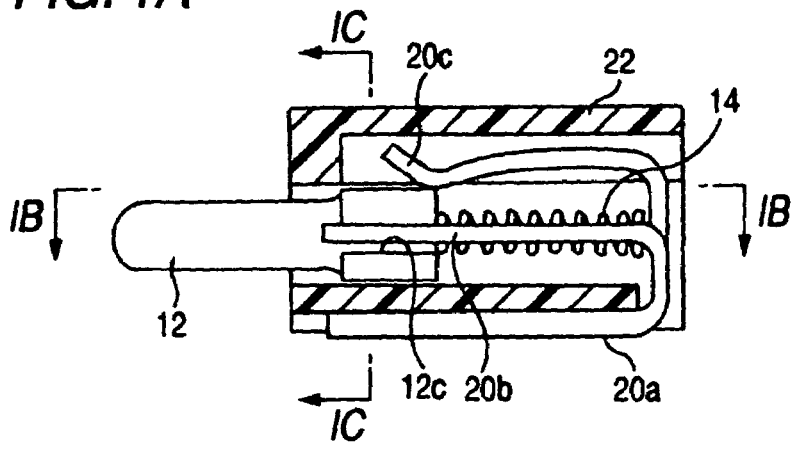
FIG. 1A is a vertical section view of a spring connector according to a first embodiment of the invention.
Figure 1B:
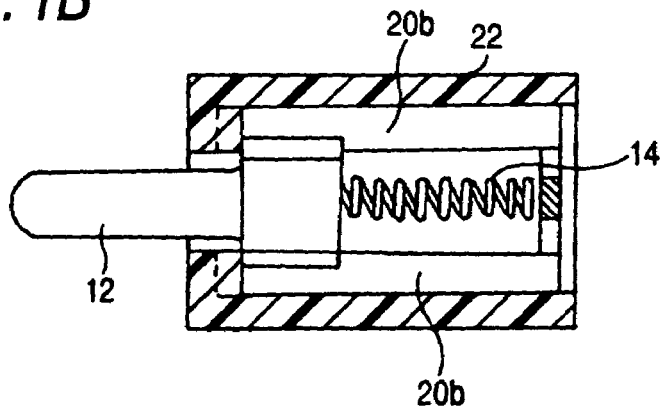
FIG. 1B is a section view taken along a line IB—IB in FIG. 1A.
Figure 1C:
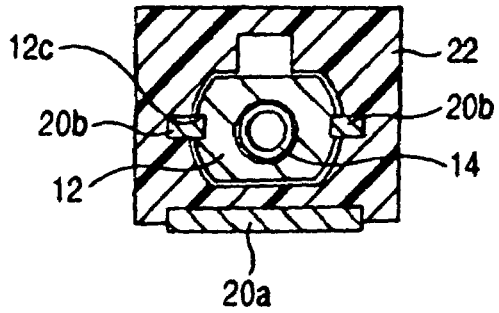
FIG. 1C is a section view taken along a line IC—IC in FIG. 1A.

Further, as shown in FIG. 1, an assembled unit of the conductive pin 12, the terminal 20, and the coil spring 14 is incorporated into a holder 22 appropriately, so that the terminal 20 may not be pulled out. In this state, a tip end of the plunger part 12*a* of the conductive pin 12 is projected from the holder 22, and the conductive pin 12 is restricted from being pulled out in a projecting direction by the presence of the protruded part 12*b*. The connecting part 20*a* of the terminal 20 is disposed on the bottom face of the holder 22.

In this embodiment, since the elastic contact part 20*c* of the terminal 20 is always in contact with the conductive pin 12, it is unnecessary to incline the sliding direction in the conductive pin 12 at a certain angle with respect to the direction of movement of the contact terminal 18, as in the conventional example. Even though the directions are in parallel with each other, reliable electrical connection can be obtained. In addition, the grooves 12*c* in the conductive pin 12 are pressed against upper faces of the guide parts 20*b* with an elastic force of the elastic contact part 20*c*, and electrical connection can be obtained also in these areas.

Next, a second embodiment of the invention will be described with reference to FIGS. 4A to 5C. Components similar to those in the first embodiment will be designated by the same reference numerals, and repetitive explanations for those will be omitted.

Figure 4A:
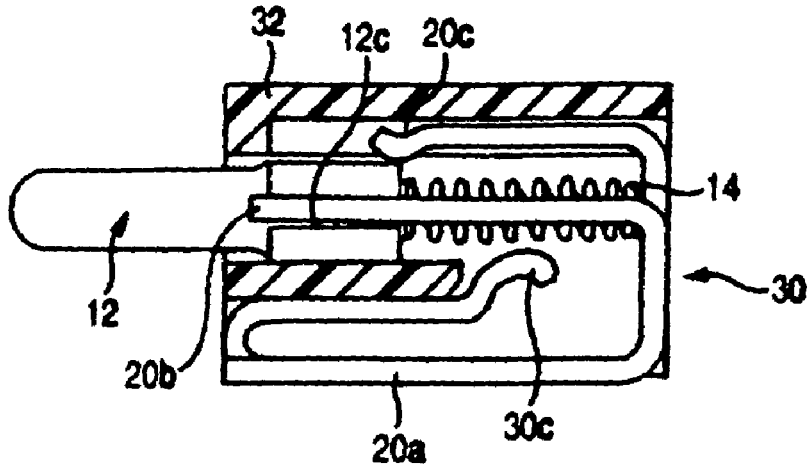
FIG. 4A is a vertical section view of a spring connector according to a second embodiment of the invention.
Figure 4B:
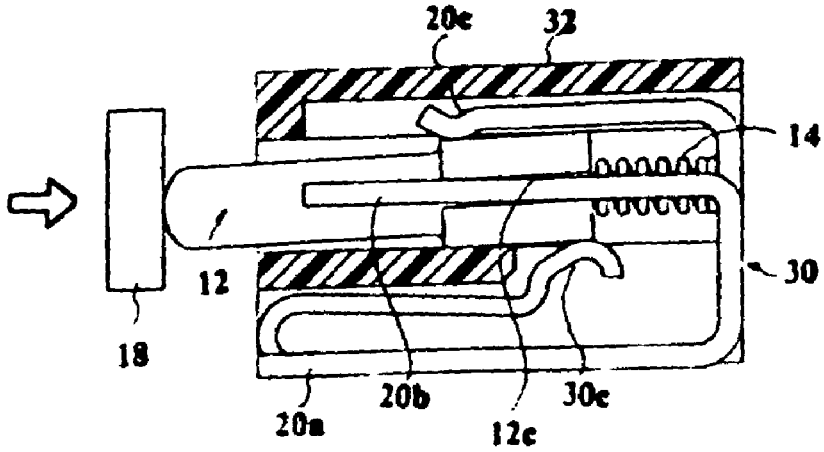
FIG. 4B is a vertical section view of the spring connector of FIG. 4A, showing a state that a conductive pin is retracted by a contact terminal.
Figure 5A:
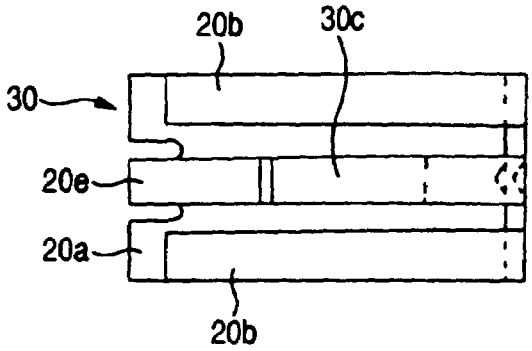
FIG. 5A is a top view of a terminal in the spring connector of FIG. 4A.
Figure 5B:
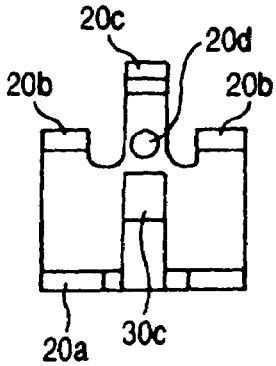
FIG. 5B is a front view of the terminal of FIG. 4A.
Figure 5C:
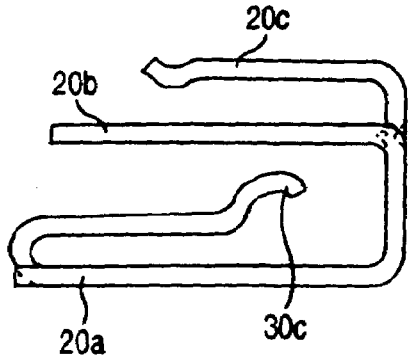
FIG. 5C is a side view of the terminal of FIG. 4A.
Figure 6A:
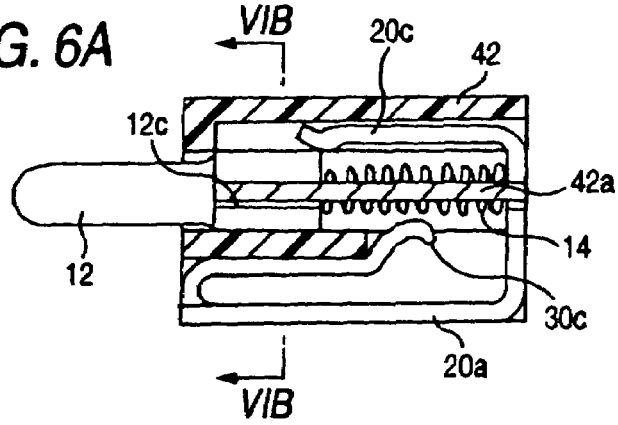
FIG. 6A is a vertical section view of a spring connector according to a third embodiment of the invention.
Figure 6B:
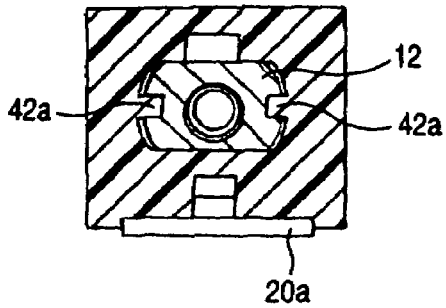
FIG. 6B is a section view taken along a line VIB—VIB in FIG. 6A.
Figure 7A:
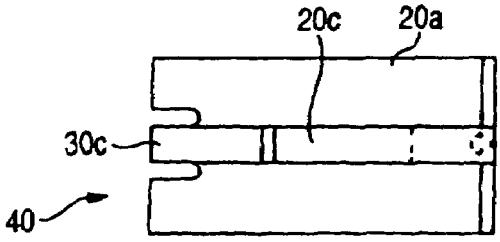
FIG. 7A is a top view of a terminal in the spring connector of FIG. 6A.
Figure 7B:
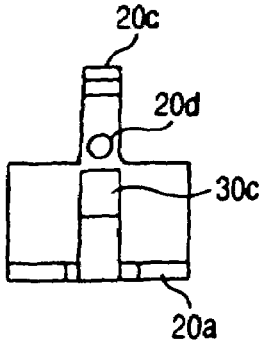
FIG. 7B is a front view of the terminal of FIG. 6A.
Figure 7C:
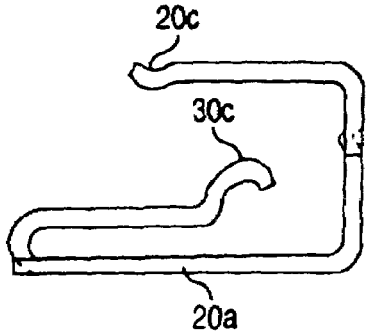
FIG. 7C is a side view of the terminal of FIG. 6A.

The second embodiment is different from the first embodiment in that, in addition to the elastic contact part 20*c* adapted to be brought into elastic contact with the conductive pin 12 from the above, a plate-shaped terminal 30 is provided with another elastic part 30*c* which is adapted to be brought into elastic contact with the conductive pin 12 from below, as shown in FIGS. 5A to 5C. It is apparent that this elastic contact part 30*c* is formed in a holder 32 in such a manner that the elastic contact part 30*c* can be contacted with the conductive pin 12 from the below. Moreover, in the second embodiment, the elastic contact part 30*c* is so formed as to be brought into elastic contact with the conductive pin 12, at the almost final stage of the pushing operation of the conductive pin 12, as shown in FIG. 4B.

In the second embodiment, the two elastic contact parts 20*c* and 30*c* are brought into elastic contact with the conductive pin 12, and reliable electrical connection can be obtained. Moreover, because positions where the two elastic contact parts 20*c*, 30*c* are brought into elastic contact with the conductive pin 12 are different in the sliding direction, a prying force is exerted on the conductive pin 12, and the guide parts 20*b* of the terminal 30 are strongly pressed against both end parts of the grooves 12*c* in the conductive pin 12 to attain reliable electrical connection also in these areas. In order to pry the conductive pin 12 by these two elastic contact parts 20*c*, 30*c*, it is necessary to provide a play for the sliding movement of the conductive pin 12.

Further, since the additional elastic contact part 30*c* comes in contact with the conductive pin 12 at the almost final stage of the pushing operation of the conductive pin 12, there may be configured such that the completion of the contact operation of the contact terminal 18 is recognized through the use of the elastic contact part 30*c*. The two elastic contact parts 20*c*, 30*c* may be brought into elastic contact with the conductive pin 12 in relatively opposed positions.

Next, a third embodiment of the invention will be described referring to FIGS. 6A to 7C. Components similar to those in the above embodiments will be designated by the same reference numerals, and repetitive explanations for those will be omitted.

The third embodiment is different from the second embodiment in that, unlike the plate-shaped terminal 30 in the second embodiment, a plate-shaped terminal 40 is not provided with a pair of guide parts 20*b*. Instead of the guide parts 20*b*, a holder 42 is provided with a pair of guide parts 42*a* which are adapted to be engaged with the grooves 12*c* in the conductive pin 12 thereby allowing the conductive pin 12 to slide.

In the third embodiment, a shape of the terminal 40 is more simplified. The holder side guide parts 42*a* can be easily formed by molding them integrally with the holder 42, and the entire spring connector can be advantageously manufactured with light weight and at low cost.

Figure 8A:
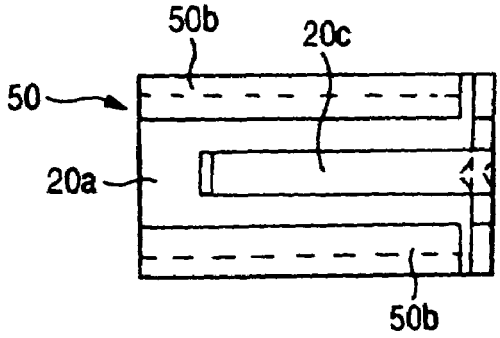
FIG. 8A is a top view of a terminal in a spring connector according to a fourth embodiment of the invention.
Figure 8B:
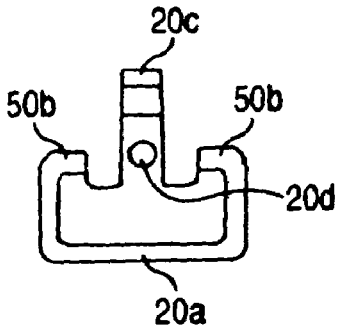
FIG. 8B is a front view of the terminal of FIG. 8A.
Figure 8C:
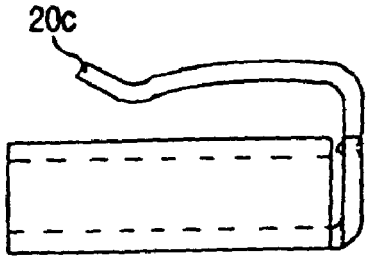
FIG. 8C is a side view of the terminal of FIG. 8A.
Figure 9A:
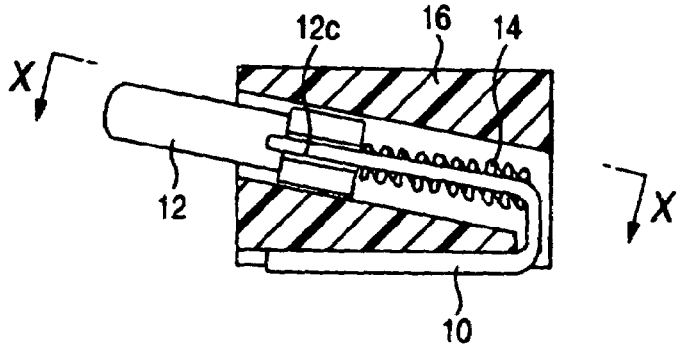
RELATED ART FIG. 9A
FIG. 9A is a vertical section view of a conventional spring connector.
Figure 9B:
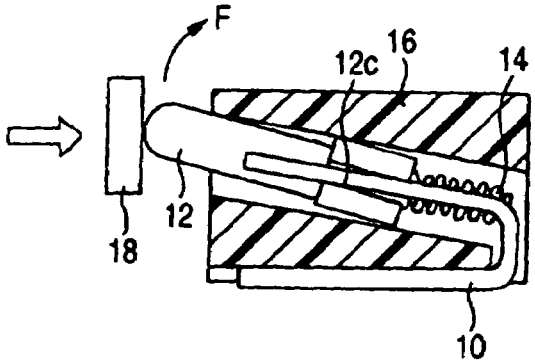
RELATED ART FIG. 9B
FIG. 9B is a vertical section view of the spring connector of FIG. 9A, showing a state that a conductive pin is retracted by a contact terminal.
Figure 10:
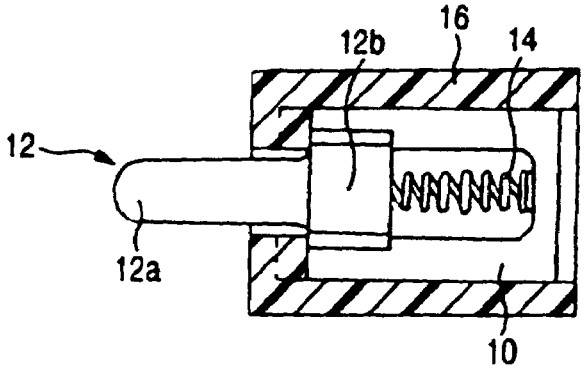
RELATED ART FIG. 10
FIG. 10 is a section view taken along a line X—X in FIG. 9A.
Figure 11A:
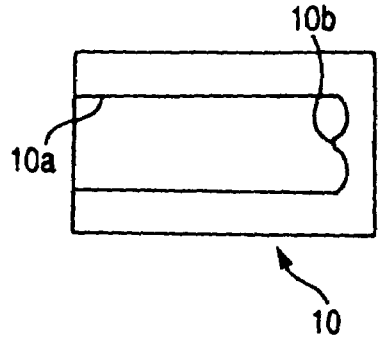
RELATED ART FIG. 11A
FIG. 11A is a top view of a terminal in the spring connector of FIG. 9A.
Figure 11B:
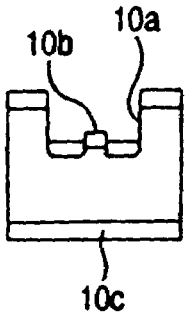
RELATED ART FIG. 11B
FIG. 11B is a front view of the terminal of FIG. 11A.
Figure 11C:
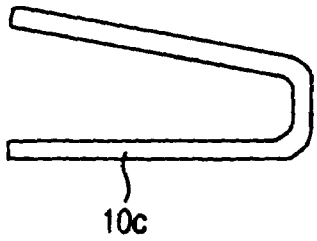
RELATED ART FIG. 11C
FIG. 11C is a side view of the terminal of FIG. 11A.

Next, a fourth embodiment of the invention will be described referring to FIGS. 8A to 8C. Components similar to those in the above embodiments will be designated by the same reference numerals, and repetitive explanations for those will be omitted.

In the fourth embodiment, unlike the first embodiment in which the terminal 20 is folded having the distal end directed in the forward direction of the conductive pin 12 and provided with the guide parts 20*b*, a plate-shaped terminal 50 is folded into a U-shape in a sectional view perpendicular to the sliding direction of the conductive pin 12, thus forming a pair of side parts extended inward from both sides of the connecting part 20*a*. Inner edges of the side parts serve as guide parts 50*b*. Although a holder is not shown in the drawing, it is apparent that the holder is formed in such a manner that the terminal 50 can be appropriately arranged and fixed thereon.

The fourth embodiment having the above described structure is more suitably employed for manufacturing the spring connector provided with the guide parts 50*b* which have strong mechanical strength, as compared with the first embodiment.

In the above described embodiments, the conductive pin 12 is guided in the sliding direction, by engagement of the guide parts 20*b* of the terminals 20, 30, 40 and the holder side guide parts 42*a* with the grooves 12*c* in the protruded part 12*b*. However, instead of such structure, the holder may be appropriately provided with a hole through which the plunger part 12*a* and the protruded part 12*b* of the conductive pin 12 are slidable. Any structure can be employed under a condition that the conductive pin 12 can be retractably projected, and the elastic contact part of the terminal can be brought into elastic contact to attain the electrical connection.

What is claimed is:

1. A spring connector, comprising:

an insulative casing, having a bottom face to be mounted on a board member;

a conductive pin, disposed in the casing so as to be slidable in a first direction parallel to the bottom face;

a conductive terminal, disposed in the casing and having at least one elastic piece which is always brought into contact with an outer periphery of the pin from a second direction perpendicular to the first direction; and an elastic member, disposed between the pin and the terminal so that a tip end of the pin is projected from the casing while being retractable in the first direction, wherein:

at least one groove is formed on at least one of side portions of the pin so as to extend in the first direction;

at least one guide member is formed on either the terminal or the casing so as to be fitted into the groove; and the guide member comes in slide contact along an upper face of the groove when the elastic piece is brought into contact with the pin.

2. The spring connector as set forth in claim 1, wherein:

a pair of grooves are formed on both side portions of the pin so as to extend in the first direction;

a pair of guide members are formed on one of the terminal and the casing so as to be fitted into the grooves, respectively; and each of the guide members comes in slide contact with an upper face of each of the grooves when the elastic piece is brought into contact with the pin.

3. The spring connector as set forth in claim 1, wherein two elastic pieces are brought into contact with the pin from opposite sides.

4. The spring connector as set forth in claim 3, wherein the elastic pieces are brought into contact with the outer periphery of the conductive pin at different positions in the first direction.

5. The spring connector as set forth in claim 1, wherein:

a groove is formed on each side portion of the pin so as to extend in the first direction, each groove having a face closer to the elastic piece and a face farther from the elastic piece;

a pair of guide members are formed on one of the terminal and the casing so as to be fitted into the grooves, respectively; and each of the guide members comes in slide contact along a face of each respective groove closer to the elastic piece when the elastic piece is brought into contact with the pin.

6. A spring connector, comprising:

an insulative casing, having a bottom face to be mounted on a board member;

a conductive pin, disposed in the casing so as to be slidable in a first direction parallel to the bottom face;

a conductive terminal, disposed in the casing and having at least one elastic piece which is always brought into contact with an outer periphery of the pin from a second direction perpendicular to the first direction; and an elastic member, disposed between the pin and the terminal so that a tip end of the pin is projected from the casing while being retractable in the first direction, wherein:

at least one groove is formed on at least one of side portions of the pin so as to extend in the first direction, the groove having a face closer to the elastic piece and a face farther from the elastic piece;

at least one guide member is formed on either the terminal or the casing so as to be fitted into the groove; and the guide member comes in sliding contact along the face of the groove closer to the elastic piece when the elastic piece is brought into contact with the pin.

* * * * *